United States Patent [19]

Wrigley

[11] Patent Number: 4,573,296

[45] Date of Patent: Mar. 4, 1986

[54] CONSTRUCTION PANEL AND METHOD OF PROVIDING THE SAME

[76] Inventor: John G. Wrigley, 6900 Almond Ave., No. 87, Orangevale, Calif. 95662

[21] Appl. No.: 675,031

[22] Filed: Nov. 26, 1984

[51] Int. Cl.[4] ..... E04H 12/18

[52] U.S. Cl. ..... 52/108; 72/307; 52/807

[58] Field of Search ..... 52/462, 484, 574, 630, 52/732, 108, 807; 72/307

[56] References Cited

U.S. PATENT DOCUMENTS

| | | | |
|---|---|---|---|
| 2,097,598 | 11/1937 | Pavlecka | 52/574 |
| 3,367,695 | 2/1968 | Haertel et al. | 52/484 X |
| 3,537,223 | 11/1970 | Lerchenthal | 52/108 |
| 3,838,590 | 10/1974 | Van Dijk | 72/307 |
| 3,975,882 | 8/1976 | Walter | 52/797 |
| 4,147,007 | 4/1979 | Wrigley | 52/570 |

FOREIGN PATENT DOCUMENTS

| | | | |
|---|---|---|---|
| 763820 | 5/1934 | France | 52/630 |
| 572444 | 6/1957 | Italy | 52/108 |
| 306408 | 11/1968 | Sweden | 52/588 |

*Primary Examiner*—Carl D. Friedman
*Assistant Examiner*—Creighton Smith
*Attorney, Agent, or Firm*—Lothrop & West

[57] ABSTRACT

A construction panel is comprised of an originally planar, deformable sheet shaped to provide a number of pairs of fins outstanding from the sheet at substantially right angles. Each pair of fins is also disposed to merge at substantially right angles with one of a number of preferably circular cylinders each having its axis spaced from the plane of the sheet and from the axes of adjacent cylinders so that two comparable construction panels can be arranged with their cylinders interspersed preferably with each cylinder tangent to a sheet plane and to adjacent cylinders.

2 Claims, 7 Drawing Figures

CONSTRUCTION PANEL AND METHOD OF PROVIDING THE SAME

BRIEF SUMMARY OF THE INVENTION

A construction panel is comprised of an originally planar, deformable sheet shaped to provide a number of pairs of adjacent fins outstanding from one side of the sheet at substantially right angles. Each pair of fins is also disposed to merge at substantially right angles with one of a number of preferably circular cylinders, each having its axis spaced from the plane of the sheet and from the axes of the adjacent cylinders. Two comparable construction panels can be arranged with their cylinders interspersed preferably with each cylinder tangent to a sheet plane and to adjacent cylinders. The method or process comprises forming such a panel by providing a planar, deformable sheet and displacing portions of that sheet to define a plurality of parallel cylinders extending from one face of the sheet and joined to the remainder of the sheet by pairs of fins adjacent each other disposed substantially normal to the plane of the sheet and outstanding therefrom at substantially right angles.

PRIOR ART AND INFORMATION DISCLOSURE

The applicant is presently unaware of any prior art corresponding to the disclosure herein and meeting the terms of the present claims. A search, however, disclosed the following United States patents:

| | | | |
|---|---|---|---|
| 2,481,049 | Stamm et al. | 3,438,164 | Duepree |
| 3,117,616 | Mesnager | 3,768,294 | Van Dijk |
| 3,402,526 | Baxter | 3,838,590 | Van Dijk |
| 3,418,792 | Quintilian et al. | 3,888,959 | Phillips |

DETAILED DESCRIPTION

Figure 1:
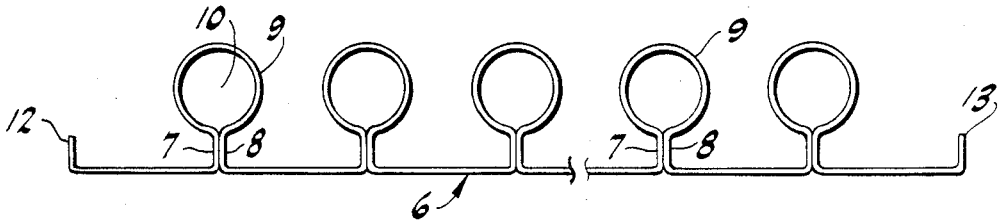
FIG. 1 is a cross-section in a transverse plane normal to the general plane of a construction panel showing the end configuration thereof.

For use in many different environments, including closure panels for structures, panels useful in affording insulation, panels useful in absorbing or dissipating heat, panels useful in conducting various fluids and for various other purposes, there is conveniently provided, as especially shown in FIG. 1, what is initially a planar sheet 6 of suitable, bendable or deformable or stretchable material such as plastic or metal of any desired area and of any selected thickness. The sheet 6 is deformed from its initially planar configuration to provide at intervals upstanding, adjacent fins 7 and 8. Each of the fins is located at a dihedral angle of about ninety degrees to the general plane of the initial sheet 6 and preferably has virtually right-angle corners, although some rounding is expected.

The fins 7 and 8 are disposed in virtual abutment or closely adjacent each other and are outstanding from one face of the panel to a distance so that they merge smoothly, and again preferably at right angles, with a circular cylindrical tube 9 deformed from the sheet. There are usually several tubes or cylinders arranged parallel to each other, each being symmetrical about its own axis 10 so that the spacing between adjacent cylinders 9 is slightly less than the diameter of the individual cylinders. The cylinders preferably, although not necessarily, are all of equal diameter.

Figure 3:
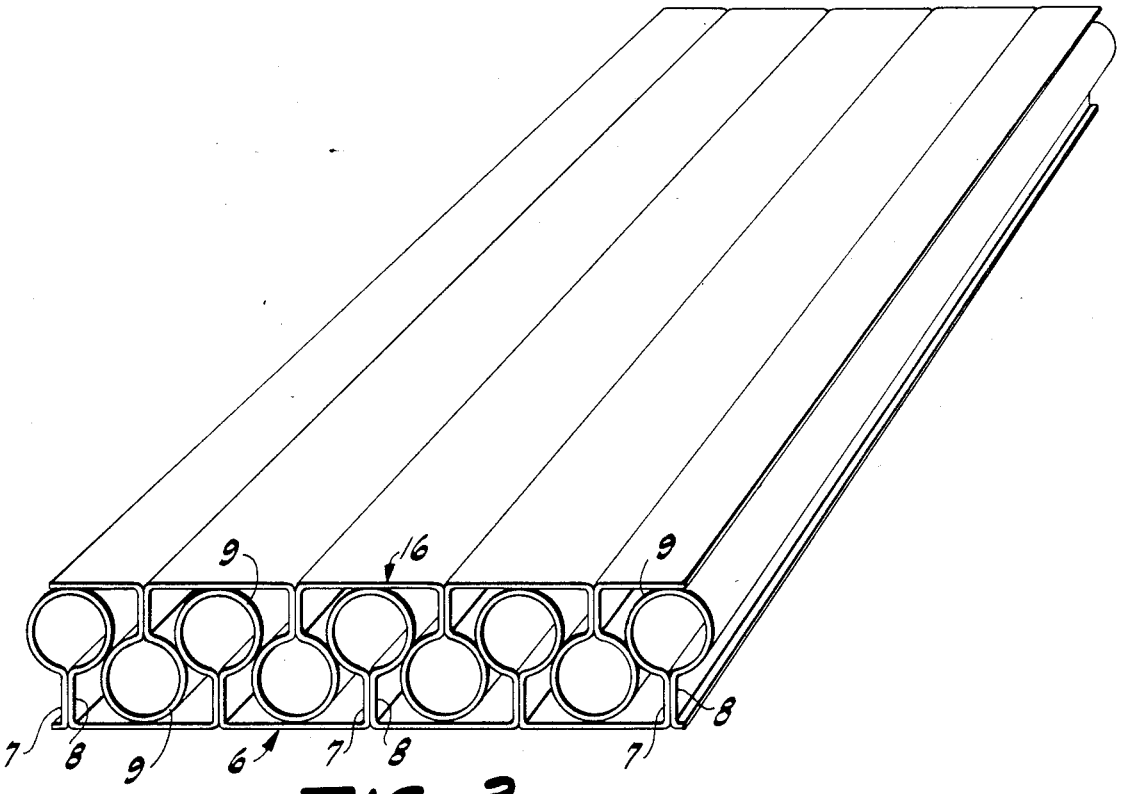
FIG. 3 is an isometric view showing two structures as indicated in FIG. 1, but with their circular, tubular portions interspersed.

Any desired number of the parallel cylinders 9 are provided on one side of the sheet. At the ends, the sheet is preferably afforded upturned flanges 12 and 13 approximately corresponding to the fins 7 and 8. With the configuration shown in FIG. 1, it is often desired to provide a multiple arrangement as shown in FIG. 3 in which one of the panels 6 is provided as shown in FIG. 1 and another panel 16 of substantially the same configuration is inverted and is assembled with the initial panel 6 so that the various cylinders 9 are interspersed. This requires some displacement, especially of the cylinder material, as the panels are interspersed. Since the material is sufficiently resilient or springy, the construction and assembly can readily be accomplished. As an alternative, the individual panels such as 6 and 16 can initially be bent into an arcuate form rather than a planar form and can be interspersed in the fashion of gear teeth and can thereafter spring back to planar form, if desired. The result is a multiple panel as shown in FIG. 3, preferably with each of the cylinders 9 disposed so that it is tangent to adjacent cylinders and is also tangent to the inner surface of the panels 6 or 16.

Figure 2:
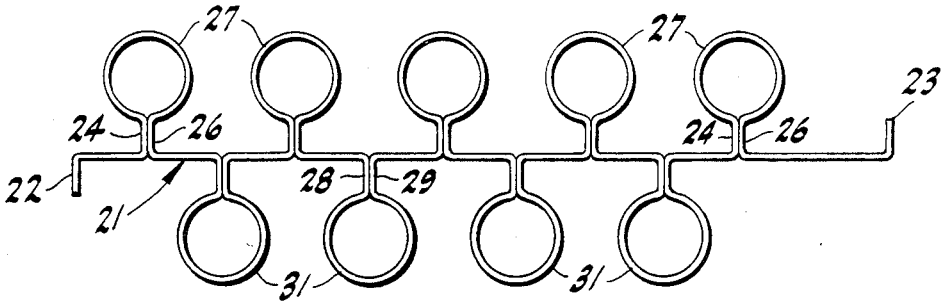
FIG. 2 is a view comparable to FIG. 1 but showing a modification of the construction of FIG. 1.

A variation in configuration is as illustrated in FIG. 2 in which the initial sheet 21 of a planar nature is deformed to provide end flanges 22 and 23. Intermediate such flanges the sheet is deformed to provide outstanding fins 24 and 26 on one side merging with a tubular shape 27 and is also provided with fins 28 and 29 on the other side of the panel merging with a tubular cylinder 31. The structure as shown in FIG. 2 can have its cylinders interspersed on both sides with similar constructions either like that of FIG. 1 or like that of FIG. 2. In the latter instance there are four cylinders in thickness across the assembled panels.

Figure 4:
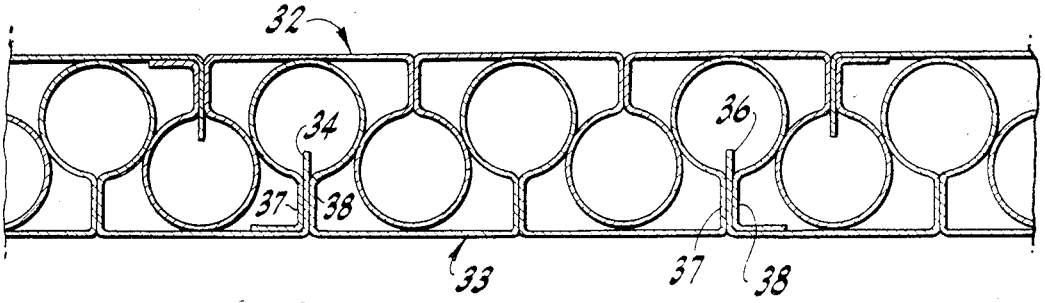
FIG. 4 is a cross-section comparable to FIG. 2, but showing a modified form of construction with panel end flanges interspersed.

In assembling panels there can be adopted an arrangement as shown in FIG. 4 in which a panel 32 and a panel 33 quite similar to the panel 6 are arranged so that end flanges 34 and 36 are interleaved with the fins 37 and 38 of the various circular cylinders. The flanges 34 can be introduced between the adjacent fins by utilizing some force and displacing the fins slightly, with the result being a tight joint, although by varying the dimensions somewhat a structure can be made in which there can be air flow or liquid flow between and along the fins and flanges.

The method or process of providing a construction panel of the sort shown in FIG. 1, for example, and which can be readily expanded or augmented to provide the other configurations shown, initially receives a planar sheet 41 from a source to the right of the figure and extending over a number of forming rollers 42 to a pair of drawing rollers 43 and 44. Initially the sheet is drawn to the position shown in FIG. 5, resting on the rollers and lying just beneath successive forming bars 46 and 47, each of which is substantially rectangular in configuration and at intervals is connected to interspersed, vertically and laterally movable actuators 49 and 51.

Figure 5:
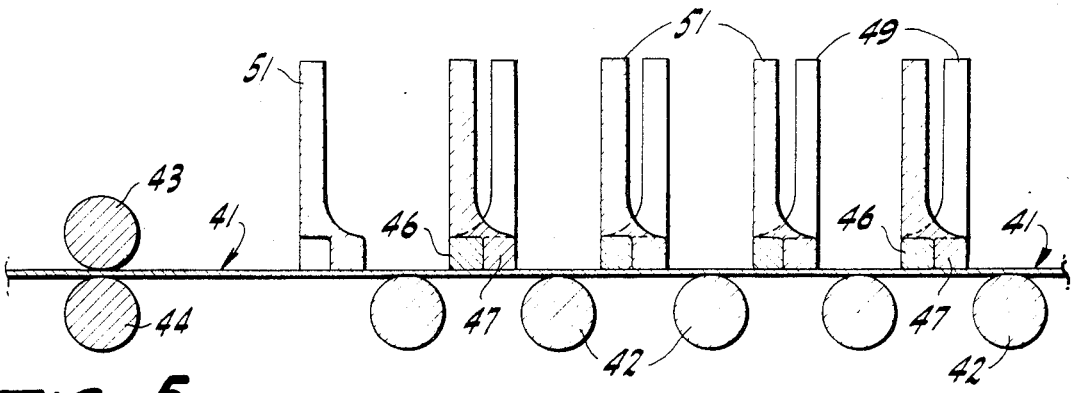
FIG. 5 is a diagram showing schematically in cross-section similar to the other figures, the initial step of a forming process for the construction panel.
Figure 6:
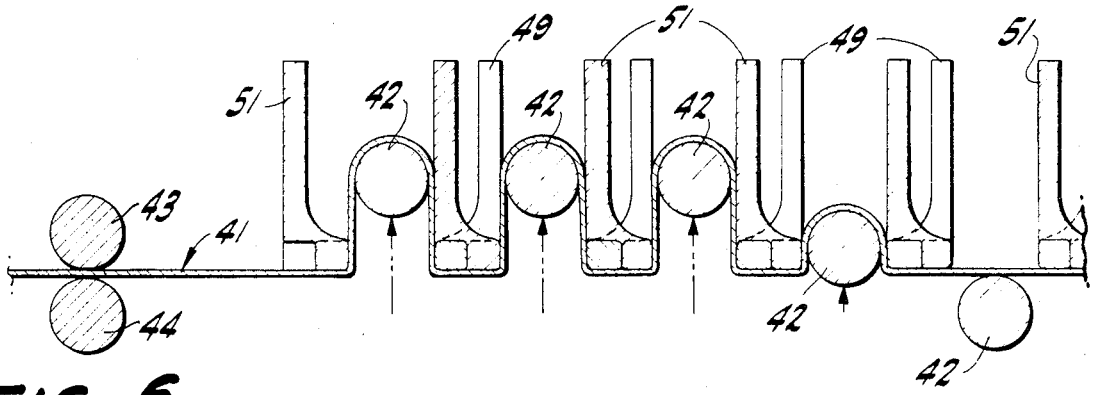
FIG. 6 is a view comparable to FIG. 5, but disclosing later stages in the process of forming the product.

After the sheet has been drawn into the position shown in FIG. 5, the bars 46 and 47 are held in position, but at least some of the forming rollers 42 are lifted from their initial position so that they deform the sheet upwardly between the adjacent ones of the bars first into substantially a semi-circular cross-section as shown toward the right end of FIG. 6, and as the rollers travel farther upwardly then into the finished semi-circular configuration of each of the cylindrical portions of the sheet. The sheet is bent around the rollers and against the substantially square corners of the forming bars.

Figure 7:
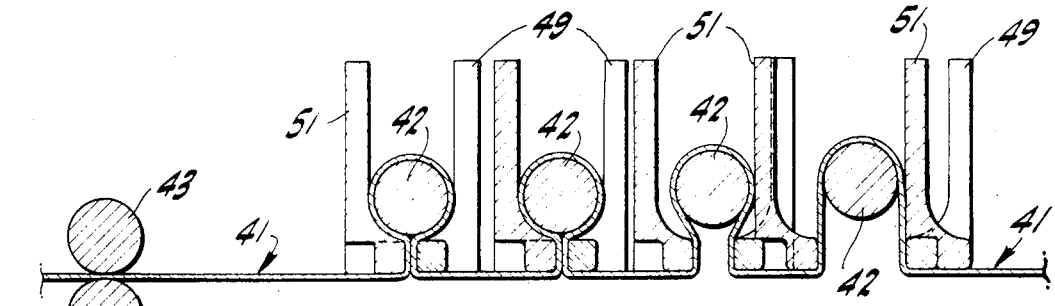
FIG. 7 is a view comparable to FIGS. 5 and 6. but showing still later stages in the process of formation of the construction panel.

As a next step, the forming rollers 42 are left substantially in their uppermost position as shown in FIG. 6 and are retained in that position approximately at the left end of the device while the bars 46 and 47 are spread apart from each other. They move toward the central plane of the adjacent rollers, which may descend slightly, so that the material is bent under and around the rollers. As the process progresses toward the left in FIG. 7, the individual rollers are gradually lowered toward the then subjacent forming bars to result in the finished configuration of the construction panel as shown in FIG. 1. Finally, the formed sheet is preferably withdrawn endwise from the forming bars and the forming rollers and is available for use, and the machine elements are returned to their position of FIG. 5 and are ready for a subsequent operation.

During the forming operation the material is appropriately fed to the forming dies and is deformed and stretched to result in the desired end cross-sectional configuration.

The final product can have further steps taken with respect to sealing the space between adjacent fins to preclude flow therethrough or even to open up the space between such fins for ready flow, depending on the ultimate use and function of the construction panel. In addition, the fins can be secured to each other; for example, by spot welding if they are of metal or by appropriate cement if they are of plastic, so that they become even more rigid. The panels as so formed can also be covered on one or both sides with appropriate diaphragms to act as further sealing or enclosing members, themselves fastened in place appropriately. In some uses wherein the cylindrical or tubular portions are utilized as ducts for heating or cooling air or water, the ends thereof are provided with appropriate manifolds or are continued by endwise joining adjacent panels of a similar nature.

I claim:

1. A construction panel comprising:

a. a deformable sheet having a plurality of identical, uniformly spaced apart, parallel forms, (1) each form including flat portions lying in a common plane, (2) each form including a nearly complete circular cylinder, the axis of which is parallel to said common plane and is spaced from said common plane a predetermined distance, said nearly complete circular cylinder having adjacent edges, and (3) each form including a pair of parallel flat fins each connected to an adjacent one of said flat portions and to an adjacent one of said edges of said cylinder, and upstanding in virtual abutment in a direction substantially normal to said plane and approximately radial to said cylinder, said fins being yieldable to the insertion of a planar portion of said deformable sheet between them.

2. A construction panel as in claim 1 in which said deformable sheet includes a flange at each end thereof extending from said sheet in the same direction as said fins and being adapted to fit between a pair of said fins.

* * * * *